United States Patent [19]
Clark, Jr. et al.
[11] 4,256,230
[45] Mar. 17, 1981

[54] CANTILEVER STRADDLE CARRIER

[76] Inventors: Clinton B. Clark, Jr., 8360 SW. 184th La., Miami, Fla. 33157; Scott S. Corbett, Jr., 6412 SE. 29th, Portland, Oreg. 97202; Allen E. Van Duyn, 17140 29th Ave. North, Wayzata, Minn. 55391

[21] Appl. No.: 44,079

[22] Filed: May 31, 1979

[51] Int. Cl.[3] ..... B66C 5/02

[52] U.S. Cl. ..... 212/216; 414/460; 212/220

[58] Field of Search ..... 212/13, 14, 125; 414/458, 459, 460, 461; 294/67 BC, 67 B, 81 SF

[56] References Cited

U.S. PATENT DOCUMENTS

| | | | |
|---|---|---|---|
| 2,699,874 | 1/1955 | Bernaerts | 212/13 |
| 3,006,485 | 10/1961 | Martin | 414/542 |
| 3,081,883 | 3/1963 | Minty | 212/13 |
| 3,146,903 | 9/1964 | Bjorkland | 414/460 |
| 3,243,061 | 3/1966 | McKeown | 414/458 |
| 3,344,940 | 10/1967 | Burgess et al. | 414/460 |
| 3,381,833 | 5/1968 | Gordon | 414/459 |
| 3,452,892 | 7/1969 | Modenesi | 414/460 |
| 3,494,491 | 2/1970 | Sumida | 414/460 |
| 3,520,431 | 7/1970 | Tax | 414/460 |
| 3,543,953 | 12/1970 | Ponsen | 414/140 |
| 3,807,591 | 4/1974 | Zinno et al. | 414/460 |
| 3,982,644 | 9/1976 | Pease | 414/460 |
| 4,127,204 | 11/1978 | Keller et al. | 414/460 |

*Primary Examiner*—David A. Scherbel
*Assistant Examiner*—Kenneth Noland
*Attorney, Agent, or Firm*—Burd, Bartz & Gutenkauf

[57] ABSTRACT

A straddle carrier for handling cargo containers is shown having a rectangular elevated frame with a trolley that travels back and forth over the area defined by the frame, a pair of forward support columns mounted on wheels that are located outward from the sides of the elevated frame and rearward from the front of the frame, a pair of rear support columns mounted on wheels that depend from the rear of the frame which are obliquely disposed to be closer to one another at ground level and spread apart at their juncture with the frame, and load grappling means supported from the trolley.

5 Claims, 6 Drawing Figures

CANTILEVER STRADDLE CARRIER

BACKGROUND OF THE INVENTION (a) The Field of Invention

This invention relates to specialized vehicles known as straddle carriers that are used for such purposes as lifting and manipulating large packing containers and transport van bodies.

(b) Description of the Art

A straddle carrier is a vehicle that can either move over a load or bring a load underneath its structure, so that it can lift the load and carry it about with ground engaging wheels of the carrier being on both sides of the load. They are typically used in the handling of large, standardized shipping containers transported on railway cars and in barges and ships. They are also used in lifting and moving vans of trailer trucks, such as used in "piggyback" shipping. A straddle carrier finds use in loading and unloading containers from a railway car or a ship, or in stacking containers one above another in storage depots, or in trans-shipping containers and vans from one type of conveyance to another.

A typical form of straddle carrier has a central bay defined by side frames and an arched framework bridging between the side frames that extends over the bay. The side frames have ground engaging wheels that are powered and steerable. A cab for a driver is at one end, and in use the straddle carrier is driven over a load, the load is lifted so as to be supported from the arched framework, and the carrier is then driven for transporting the load to its next location. In such straddle carriers the carrier itself is driven about to move the load from one location to another.

There are similar forms of cargo handling apparatus which also raise, lower and straddle loads. These commonly comprise overhead cranes supported on wheel mounted frameworks to have a mobile apparatus. Typical of these structures are rail mounted cranes that travel alongside piers and docks in shipyards and ports. They usually employ either luffing or overhead traveling cranes that overhang the ships they service, and in some of these structures the crane can travel inside the wheel mounted framework in order to carry loads along a pier or docks from one point to another.

The art has not provided highly mobile container handling machines that are sufficiently versatile to function in a confined space to straddle a load, shift the direction of alignment of the load while standing still, support the load either within the perimeter of its ground engaging supporting structure or in a position cantilevered from such structure, and also turn within a short radius to achieve mobility. A straddle carrier having these several attributes would be particularly useful in railroad yards for trans-shipping containers or semi-trailer vans between railroad cars and trucks. If an ordinary straddle carrier is to be driven over a line of railcars to load or unload them, it has to be driven over the line of cars for each successive pick-up or depositing of a container. Also, aisle space is required on each side of the railcars to accommodate the straddle carrier. In addition, aisles between railroad tracks are narrow and frequently crowded with freight and machinery. Thus, the use of ordinary straddle carriers having load carrying bays between opposing side frames is not satisfactory for loading or unloading a string of railcars.

Four wheeled straddle carriers, with ground engaging wheels at the four corners of a rectangular base area, cannot easily be manipulated within the confines of aisles in railway yards. The turning radius of a four wheeled vehicle is relatively large, and alongside most rail tracks there is not sufficient room to turn and maneuver a four wheeled straddle carrier. There has, therefore, been a need for a mobile load handling machine that can efficiently serve confined areas, where it is not possible to simply drive a stradle carrier over the load and then drive away with the load.

SUMMARY OF THE INVENTION

The present invention relates to straddle carriers and more specificially resides in a carrier having an elevated horizontally disposed frame with a pair of parallel spaced side beams, a load lifting trolley bridging between the side beams and movable along the length of the beams, a pair of near support columns beneath the rear of said side beams that include a carriage between their lower ends which mounts power means for the carrier, rear ground engaging wheels beneath the carriage that are relatively close to one another, a pair of forward support columns supporting the side beams at positions sidewardly from and to the rear of the front of said side beams to present a wide, clear space between the columns and beneath said trolley, and ground engaging wheels supporting said forward support columns.

The structure is particularly useful for handling large, rectangular shipping containers and piggy-back type vans. Containers used in the shipping industry are usually of twenty or forty foot lengths. The sides and tops are somewhat fragile, so that they must be handled carefully. Frequently they are not loaded uniformly, so that one end may be heavier than the other. Concern must be had for providing ample distance between spaced points at which the loads are lifted, and a stable lifting and transporting mechanism must be had that will not jar or abusively treat the containers and their contents. To this end, the structure of the invention has an elevated framework including a pair of side beams that are widely spaced from one another. A load lifting trolley is supported by and bridges between the side beams that travels back and forth along the length of the beams. This trolley also has a substantial length of its own which is transverse to the beams, so that elongated containers and similar loads can be supported in parallel relation to the trolley. These loads, then, can be supported near their ends, so that uneven loads can be readily lifted and lowered without tipping of the load.

The forward ends of the trolley supporting beams cantilever outward from columns that support the elevated framework that carries the trolley. This permits the trolley to ride outward, over a railway car, or the like, in an overhanging position, so that loads can be picked up from and deposited upon conveyances or sites that a vehicle cannot drive over. For developing stability of the straddle carrier the lengthwise dimension of the container, or load, is oriented perpendicular to the direction of cantilever of the trolley. The support columns at the vehicle front are then widely spaced to provide a gap through which the load can be brought into the vehicle. The column arrangement provides stability and a more workable arrangement than if the load were oriented in the direction of trolley travel. The widely spaced front columns also define a vehicle length paralleling the loading area, wherefore the vehicle orientation is optimum for working in aisles and along docks.

In preferred form, the vehicle of the invention has a rear supporting structure, opposite the cantilevered ends of the side beams in which support columns are obliquely arranged to converge downwardly toward one another. This provides several desirable results. At their upper ends, the oblique support columns are positioned close to the main side beams, to effectively support the load carried by the trolley. At their lower ends they are close to one another, so that ground engaging wheels upon which they ride have a short wheel length between them. This short wheel length, as contrasted to the long wheel length between the wheels of the front support columns gives an effective three point support for the vehicle. A short turning radius and high mobility are thereby achieved.

A preferred form of the invention also has the prime mover and power means for operating the vehicle between the lower ends of the rear support columns. The fuel supply and oil reservoirs for hydraulic operation of the machine are also located in this position. The mass of these parts counterbalances an overhanging load carried by the trolley in its outboard, or cantilevered position, and also provides a low center of gravity to enhance machine stability.

It is an object of the invention to provide a straddle carrier that can pick-up and deposit loads outboard of the base area defined by its supporting wheels.

It is another object of the invention to provide a straddle carrier with a relatively small turning radius to render the vehicle highly mobile.

It is another object of the invention to provide a straddle carrier that can manipulate large, elongated shipping containers between a position inside the area of its supporting wheels and a position outboard of such area.

It is another object of the invention to provide a straddle carrier that has a low center of gravity.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not necessarily represent the full scope of the invention, and reference is made to the claims herein for interpreting the breadth of the invention.

DESCRIPTION OF THE PREFERRED EMBODIMENT

Figure 1:
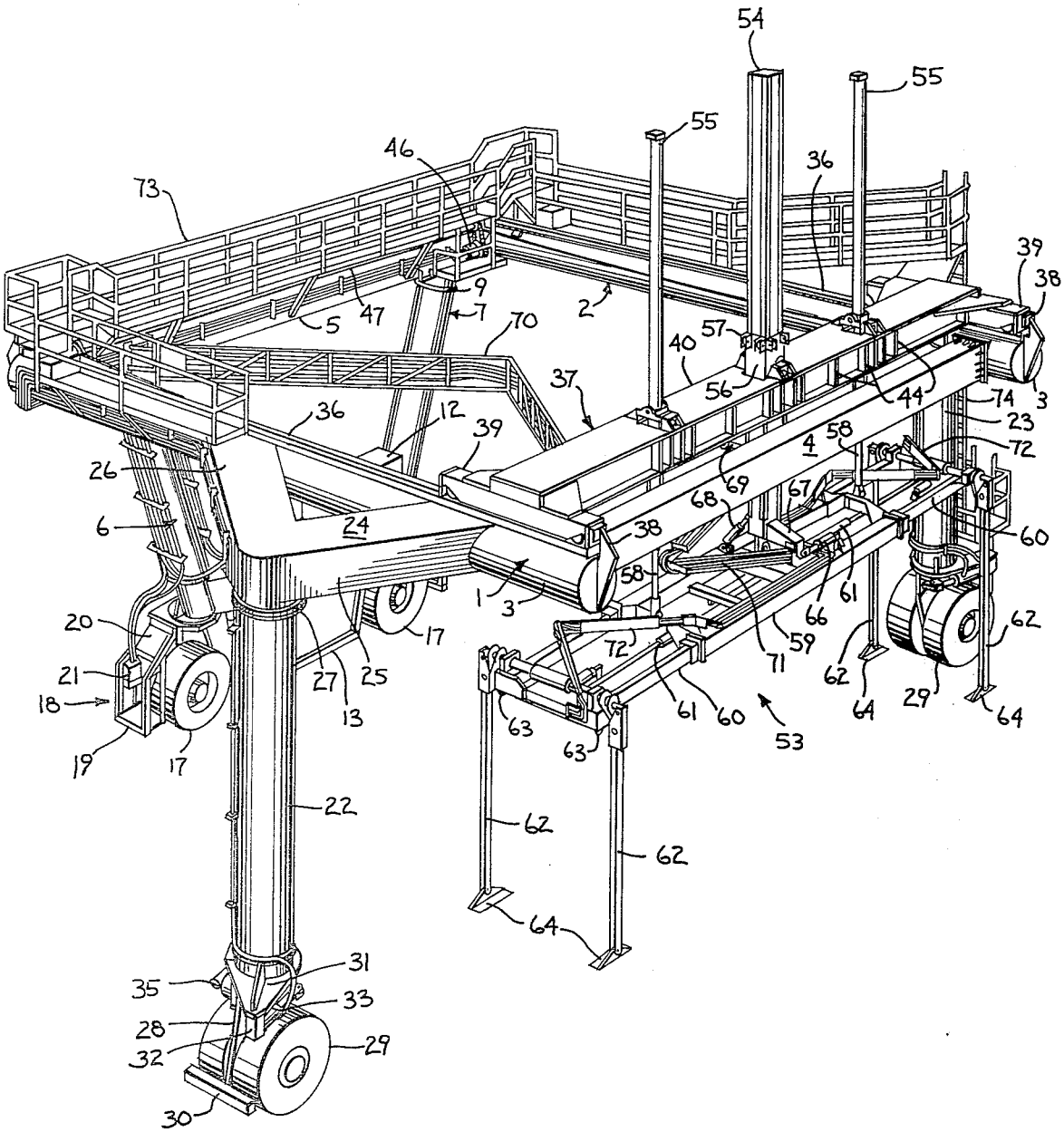
FIG. 1 is a view in perspective of a straddle carrier embodying the invention.

FIG. 1 shows in perspective a mobile, tire supported straddle carrier embodying the present invention for lifting, transporting and manipulating large loads. The carrier has a rectangular, elevated framework lying in a horizontal plane that includes a pair of spaced side beams 1 and 2 that are respectively at the right and left of the machine as one faces in the forward direction of the machine. The beams 1 and 2 are of circular, cylindrical configuration for strength and rigidity, and the forward ends 3 cantilever outward in an overhanging relation to the rest of the machine. The two beams 1 and 2 are parallel to one another to partially frame a rectangular area between them, as particularly seen in FIG. 2.

A crosswise, box shaped beam 4 spans between the side beams 1, 2 at their front ends 3 to tie them together in a rigid structure. A second crosswise, box shaped beam 5 at the rear of the machine also spans between the pair of side beams 1, 2 at their after ends to complete a rectangular framework lying in a horizontal plane at a substantial elevation above ground.

Figure 5:
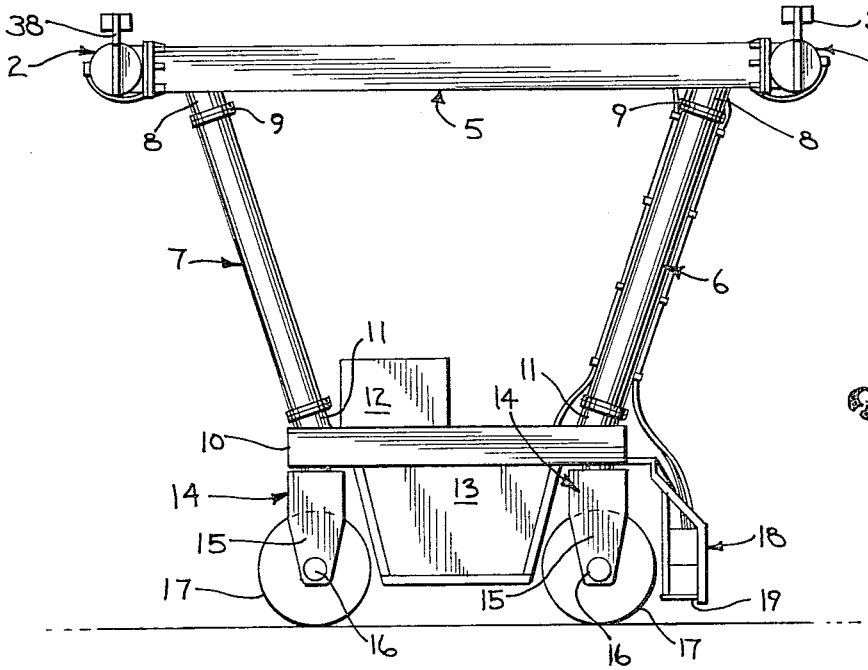
FIG. 5 is a rear view of the machine, with walkways and parts forward of the rear omitted to provide a clearer rendition of the structure at the rear.

There are two upwardly extending right side and left side rear support columns 6 and 7, respectively, that are secured to the underside of the rear crosswise beam 5, as best seen in FIG. 5. Each column 6, 7 is of circular, cylindrical shape and is bolted at its upper end to an oblique stub 8 welded to the bottom of the crosswise beam 5. Because of the scale of the drawings individual bolts are not shown around the flanges 9, at which the stubs 8 and columns 6, 7 are joined. The columns 6, 7 depend downwardly at oblique angles, so that they converge toward one another. In this fashion, the lower ends of the columns 6, 7 are closer together than the upper ends, and extending between them at their lower ends is a carriage 10 that includes connecting stubs 11.

As more clearly shown in FIG. 5, the carriage 10 mounts a fuel tank 12 and has slung on its underside a machinery housing 13. This housing 13 shrouds a prime mover in the form of a gasoline engine and associated equipment, hydraulic pumps for operating the machine motions to be hereinafter described, control valving, hydraulic fluid filters, a hydraulic fluid sump and the like. The particular arrangement of such power components does not play a part of the present invention, and can be designed in appropriate manner.

Figure 4:
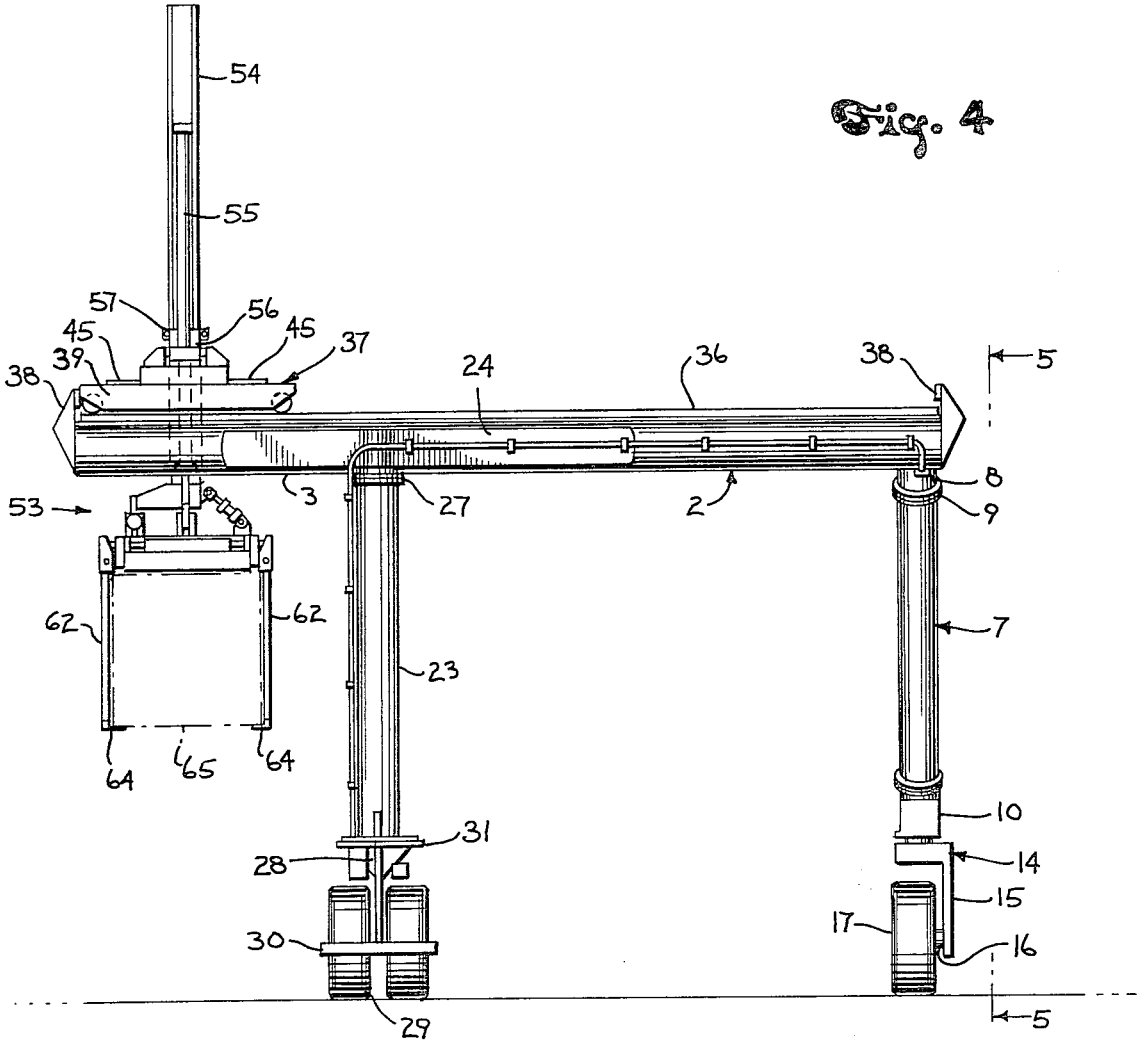
FIG. 4 is a side view of the machine with walkways omitted.

As shown in FIG. 5, on the underside of the carriage 10, and directly beneath each lower column stub 11, is a rotatable truck 14. In FIG. 4 it is seen that each truck 14 has a single, downwardly extending bracket 15 from which extends a trunnion like axle 16 mounting a large diameter rubber tired wheel 17. The employment of a single axle bracket 15 at each truck 14 allows for a more compact axle length of the truck, and as seen in FIG. 4 the carriage 10 and all the components carried by it are of a width that is about the same as the front to rear dimension, or diameter, of the rear support columns 6 and 7. The columns 6, 7, in turn, are directly beneath the rear crosswise beam 5, so that the supporting structure for the elevated framework and control machinery is confined to within a minimal width. This provides maximum working area under the machine, and also minimizes protuberances at the rear of the machine, so that it can work within confines that do not have to accommodate any unnecessary machine overhang.

As shown in FIGS. 1 and 5, an operator station 18 is mounted alongside the left rear wheel 17 by hanging it from the associated stub column 11. This station 18 has a platform 19, upon which an operator can stand, and a master control panel 20. Within the panel 20 there is a radio receiver, so that the machine can be radio controlled by an operator walking around the machine as it is in operation. The station 18 also includes manual controls 21, so that the operator can step aboard the platform 19 and ride with it as he directs machine movements.

The elevated frame comprising the side beams 1, 2 and the crosswise front and rear beams 4, 5 is supported near its front by a vertical right-forward column 22 and a vertical left-forward column 23. To connect the forward columns 22, 23 with the elevated framework there is supplementary framing that juts outwardly from each side beam 1, 2 in the form of a V-shaped truss 24. Each truss 24 is made up of a box shaped fore member 25 and a box shaped rear member 26 which converge toward one another and join at their outer ends to support a mounting flange 27 to which the upper end of the associated column 22, 23 is attached. The flanges 27, and consequently the columns 22, 23 are located sideward, or outboard, of the elevated framework, so that the working area under the machine for handling loads is enlarged. Also, the columns 22, 23 are set a substantial distance back from the front of the machine, so that the front ends 3 of the right and left side beams 1, 2 overhang forwardly of the supporting structure afforded by the columns 22, 23. This provides a work space under the machine that is to the front of the ground area on which the machine rests.

Secured to the bottom of each column 22, 23 is rotatable truck 28 that carries a rubber tired, double wheel assembly 29. A bumper 30 is also mounted on each truck 28, and directly over each truck 28 is a horizontal plate 31 encircling and fixed to the lower end of the associated column 22, 23. As seen at the lower left in FIGS. 1 and 3, a bracket 32 is fixed on the underside of each plate 31, and a hydraulic steering cylinder 33 is connected between the bracket 33 and an arm 34 extending outwardly from the associated truck 28. By operating the cylinder 33 the associated truck 28 and double wheel 29 are turned to steer the machine. Similar steering apparatus is provided for the rear wheels 17, so that four wheel steering is provided.

Figure 3:
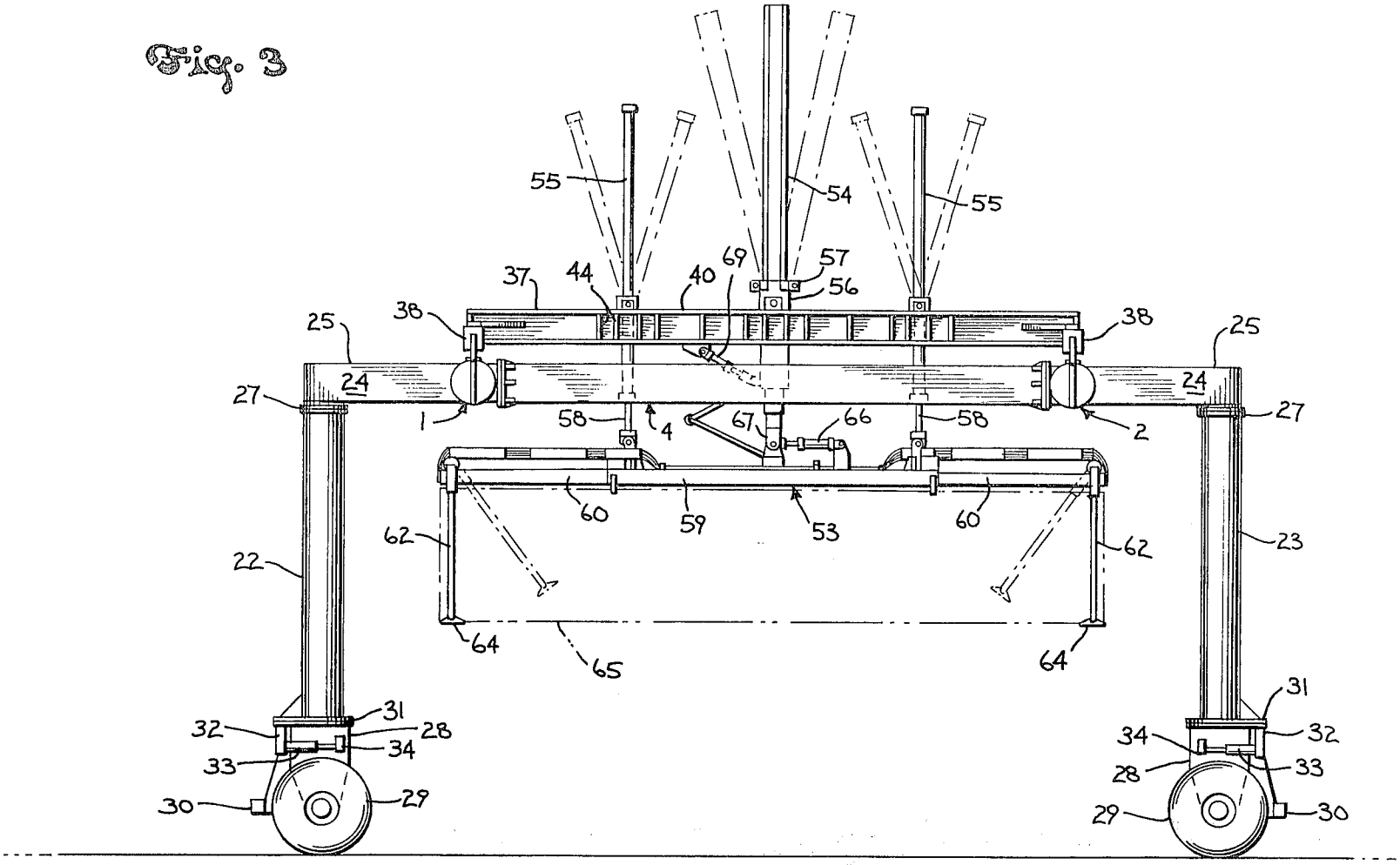
FIG. 3 is a view of the front end of the machine, with walkways and portions behind the front omitted to provide a clearer rendition of the structure at the front.

The truck 28 for the right front column 22, in the lower left of FIGS. 1 and 3, also mounts a hydraulic propel motor 35, which through appropriate gear reduction (not shown) drives the associated double wheel 29. A similar propel motor is provided for the wheel 17 beneath the right gear column 6. If desired, additional propel motors could be provided for the two remaining wheels.

Figure 2:
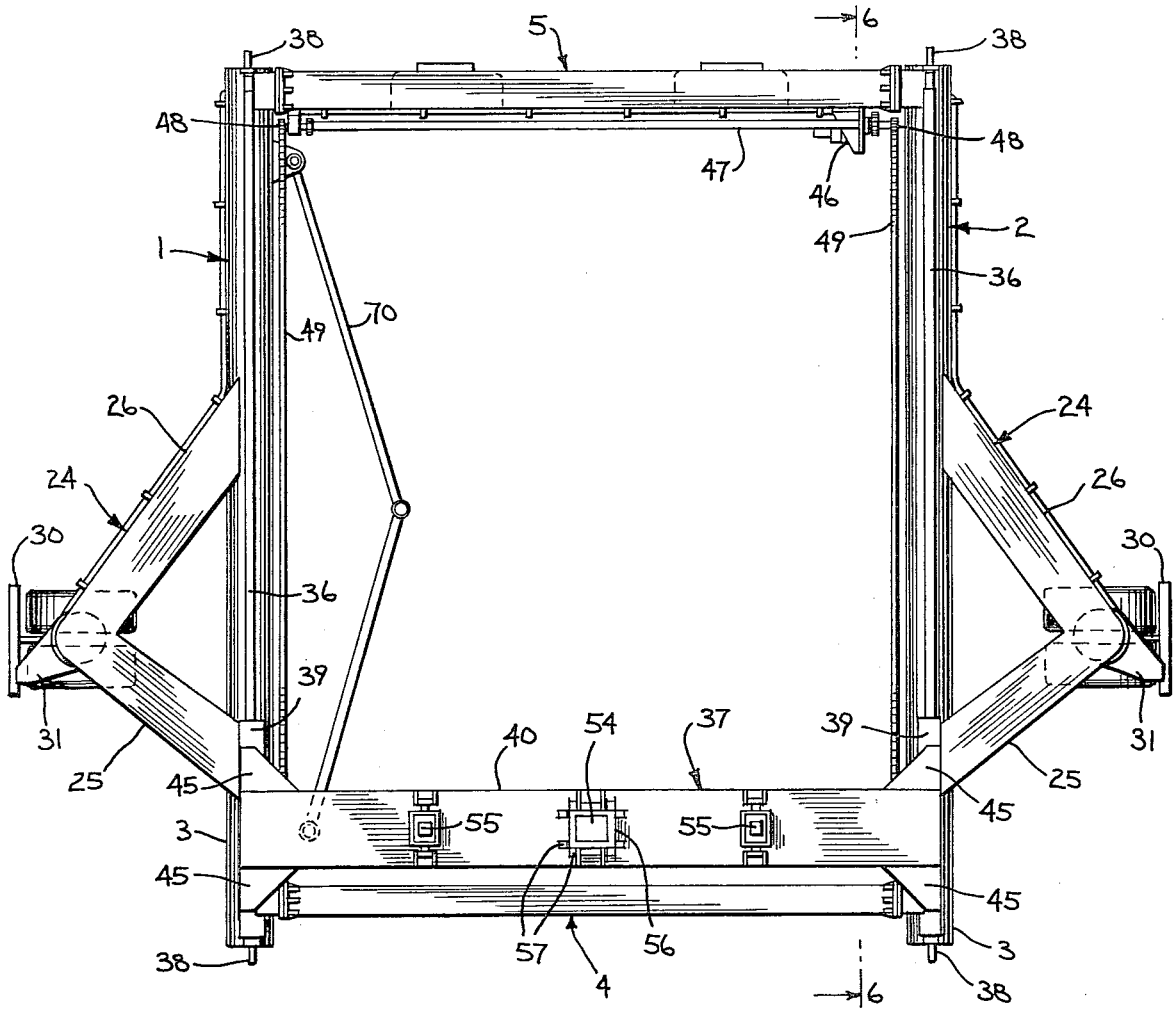
FIG. 2 is a top view of the straddle carrier with walkway removed to better show the framework of the machine.

Secured to and extending along the top of each side beam 1, 2 is rail 36. A trolley 37 bridges across the rides upon the rails 36, for travel between a forward position, as shown in FIGS. 1, 2, and 4, and a rear position alongside the rear crosswise beam 5. Trolley stops 38 are provided at the front and rear end of each rail 36 to limit trolley travel. The trolley 37 has a rectangular, box shaped truck 39 at each of its ends which overlies a rail 36. Each truck 39 has a pair of wheels located at the truck ends that ride upon the associated rail 36, and extending between the two trucks 39 is a trolley bridge 40. The bridge 40 spans the distance between the two sise beams 1, 2, and is essentially a long box member. As shown in section in FIG. 6, the bridge 40 has top and bottom plates 41, 42 and two side plates 43 that are set in from the edges of the plates 41, 42. As particularly shown in FIGS. 1 and 3, a series of vertical stiffeners 44 are disposed along the length of the bridge 40 to give it the necessary strength and rigidity for handling large loads. At each end of the bridge 40 there is a pair of gussets 45 that are welded between the associated truck 39 and the bridge end to provide requisite strength for the support of the bridge 40.

Figure 6:
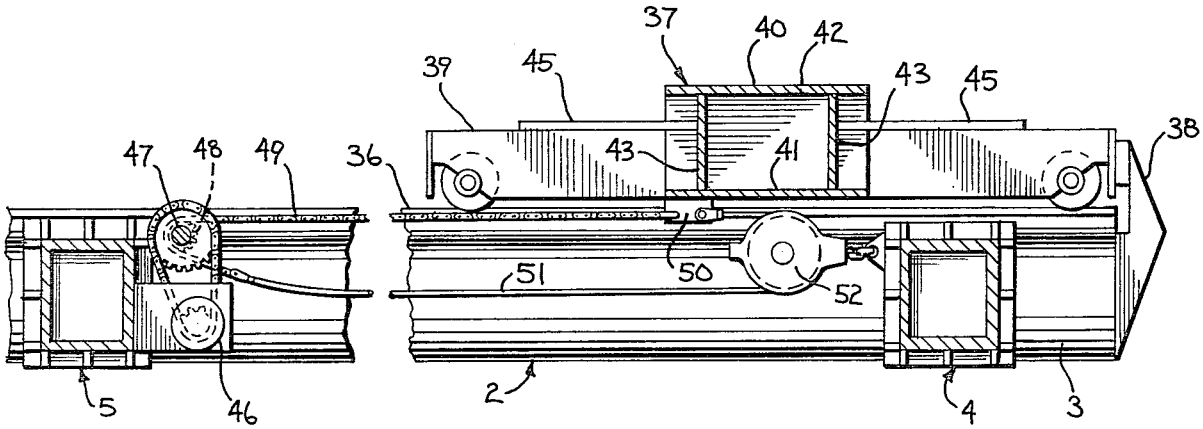
FIG. 6 is a partial view in section taken through the plane 6–6 indicated in FIG. 2 showing drive mechanism for propelling a trolley along its tracks.

To propel the trolley 37 along the rails 36 there is mounted in the left rear corner of the framework a hydraulic motor 46 which through a chain and sprocket arrangement turns a drive shaft 47. The location of these elements is shown in FIGS. 1 and 2, and the arrangement of the motor 46 with the chain and sprocket are best shown in FIG. 6. The drive shaft 47 extends alongside the full length of the rear cross beam 5, and at each end is a small diameter drive sprocket 48. Each sprocket 48 drives a trolley propel chain 49, one of which is shown in FIG. 6.

The trolley propel chain 49 shown in FIG. 6 extends along the side beam 2 and is connected at one end to a bracket 50 on the underside of the trolley bridge 40. The other end of the chain 49 connects to a flexible cable 51 that extends forwardly to a pulley 52 mounted on the rear side of the forward cross beam 4, and around the pulley 52 to return to a connection with the bracket 50. By operation of the hydraulic motor 46 the chains 49 at opposite sides of the machine are reeved forward or backward to propel the trolley 37 along the rails 36. By this arrangement the trolley 37 can be positioned over any part of the area encompassed by the framework of the side beams 1, 2 and the front and rear beams 4, 5. This area, in turn, includes both a space within the quadralateral area of the machine wheels 17, 29 and a space forward of the line between the front wheels 29.

Carried by and hanging from the trolley 37 is a load grappling spreader frame 53. This spreader frame 53 is particularly adapted for lifting and manipulating large rectangular shipping containers as used in railroad transport systems, barges, semi-trailer trucks and the like. The particular form of the spreader frame 53 is not a part of the present invention, and other grappling means might be used in its place. It is described in greater detail in the copending application of Quinten K. Fadness, Ser. No. 044,006 filed May 31, 1979 entitled Adjustable Load Lifting Spreader Frame and only a general description will be given here.

The spreader frame 53 is raised and lowered from the trolley 37 by means of a vertical guide column 54 and two vertically disposed hydraulic raise-lower cylinders 55. The column 54 protrudes through the center of the trolley bridge 40, is of box configuration, and is guided for ascent and descent by a rectangular tube 56 pivotally mounted on the top of the bridge 40. Roller wheels 57 are placed on each of the four sides of the guide tube 56 that roll against the sides of the guide column 54. The guide columns 54 is consequently free to move upward and downward, and can also be pivoted from side to side, as shown in phantom in FIG. 3.

The two hydraulic raise-lower cylinders 55 similarly protrude through the trolley bridge 40, and are positioned to the sides of the vertical guide column 54. The casing of each cylinder 55 is pivotally mounted on the trolley bridge 40, so that the cylinders 55 can tilt sidewardly in unison with any tilt of the guide column 54. The telescopic rod ends 58 of the cylinders 55 extend beneath the trolley bridge 40.

The lower end of the guide column 54 and the rod ends 58 of the two raise-lower cylinders 55 are connected to a rectangular center section 59 of the spreader frame 53. From each end of the center section 59 there extends a telescopically mounted end section 60, and hydraulic cylinders 61 are provided in the frame 53 for moving the end sections 60 inwardly and outwardly of the center section 59, so that the overall length of the spreader frame 53 may be adjusted to match the length of a freight container that is to be transported by the machine.

A pair of grappler legs 62 are mounted at the outer end of each end section 60, and they are pivoted at their upper ends so that they may depend vertically downward, as shown in FIGS. 1, 3 and 4, or be raised about their upper ends to lie horizontally alongside the frame members comprising the center and end sections 59, 60. When the legs 62 are in such raised positions, the spreader frame 53 may be attached to a freight container by means of standard twist-lock connectors 63 (see FIG. 1) at the under corners of the spreader frame 53. Such connectors 63 are standard in the shipping industry, and upper corners of freight containers are regularly equipped with matching connecting elements.

When the legs 62 are projecting downward, as shown in the drawings, inwardly turned feet 64 at the leg lower ends can be positioned under a container for grappling about the lower container edge. In FIGS. 3 and 4 a container 65 shown in phantom has been hoisted in this manner.

The position of the spreader frame 53 can be shifted in any of several degrees of movement with respect to the body framework of the straddle carrier. To achieve this flexibility of manipulation, the connections between the center section 59 of the spreader frame 53 with the lower ends of the vertical guide 54 and the raise-lower-cylinder rods 58 are pivoted, and a set of hydraulic cylinders are provided to manipulate the spreader frame position.

A first cylinder 66, seen in FIGS. 1 and 3, is disposed between the spreader frame center section 59 and a horizontal forwardly projecting arm 67 at the lower end of the guide column 54. By operation of this cylinder 66 the spreader frame 53 can be pivoted about its vertical axis. A second cylinder 68, seen in FIG. 1, extends obliquely between the spreader center section 59 and the guide column 54. Operation of this cylinder 68 tilts the spreader frame 53 about its longitudinal axis. A third cylinder 69, best seen in FIG. 3, is joined between the underside of the trolley bridge 40 and the pivoted tube 56. Upon its operation the tube 56 and guide column 54 are pivoted so that the spreader frame 53 is shifted along its longitudinal axis. The spreader frame 53 can be pivoted about its transverse axis by moving one of the rod ends 58 with respect to the other, and to move the spreader frame 53 along its transverse axis the trolley 37 is propelled along the rails 36. Thus, the spreader frame has five different degrees of movement.

To complete the construction of the straddle carrier, hydraulic control lines are extended from the carriage 10 throughout the machine. Electrical lines are also distributed as necessary. These lines are conveniently strung along the sides of the supporting columns 6, 7, 22 and 23, the front face of the rear cross beam 5, and portions of the side beams 1, 2 and the trusses 24. In order to deliver hydraulic fluid and control to the trolley 37 an articulated bracket 70 hinged at its ends carries hydraulic and electrical lines from the rear of the structure to the trolley bridge 40, as seen in FIGS. 1 and 2. A similar articulated bracket 71 hinged at its ends supports lines from the bridge 40 to the spreader frame 53, and additional brackets 72 support lines running out to the telescopic end sections 60. The straddle carrier also includes catwalks 73 and an access ladder 74 that are shown in FIG. 1. These elements have been omitted from the other figures for sake of clarity.

The described straddle carrier can raise and lower loads in positions outside the perimeter of the ground area defined by its ground engaging wheels, and can move such loads inside or outside such ground area. It can straddle loads by moving in either of its sideward directions, or it can straddle a load by moving in its forward direction. The machine also has a relatively small turning radius, by virtue of its rear wheels being spaced from one another a distance less than one-third the spacing between the front wheels, such spacing being measured from wheel axis to wheel axis. In effect, this wheel spacing provides a tripodal form of ground engagement for the vehicle. Versatility is further enhanced by supporting the spreader frame so that it has several degrees of movement. Loads can then be grappled, or engaged, without necessity of aligning the entire vehicle. Also, a raised load can be manipulated so as to be set down in any desired orientation without the necessity of moving the entire vehicle.

The forward legs, or support columns, are spreads far apart so that the full length of an elongated load can be straddled by these legs. A trolley is supported by an elevated framework which has its length in the same direction as the spacing between the forward columns, and its direction of travel is transverse to this direction. The trolley supporting framework has a large open, central area over which the trolley can run, and the sidewise opening of this framework, and also the length of the trolley is approximately two-thirds the distance between the front support columns where they engage the ground. The side beams of the elevated framework upon which the trolley runs are then each positioned about midway between the points of ground engagement of the upright forward columns and rear oblique columns. This position of the side beams minimizes the overhang of the V-shaped trusses while at the same time permitting the oblique rear columns to attach to the elevated framework at points near the side beams.

At the rear of the machine, the prime mover and operating machinery are mounted near ground level within a widthwise dimension substantially the same as the width of the supporting columns and framework. This makes optimum usage of space under the vehicle and minimizes overhanging machinery outside the perimeter of the ground engaging wheels. Also, at the rear the support columns are oblique to the vertical to provide wide support at the top and reduced spacing at the bottom to achieve the nearly tripodal engagement with the ground and accompanying mobility.

By having a relatively long trolley a load, such as an elongated shipping container or van body, can be lifted at two widely spaced points. This improves handling of the load. At the same time the side to side dimension of the vehicle is made quite large to achieve a nearly square, elevated frame and widely separated wheels that give stable support to the vehicle.

We claim:

1. In a straddle carrier the combination comprising:

(a) an elevated frame having a pair of horizontally disposed side beams that are parallel to and spaced from one anoother;
(b) a hoist trolley bridging between said side beams that travels along the length of the beams;
(c) load lifting means carried by said trolley for suspending a load beneath the trolley;
(d) a pair of upwardly rising rear support columns supporting said elevated frame at the after end thereof;
(e) an undercarriage extending between the lower ends of said rear support columns;
(f) prime moving machinery carried by said undercarriage;
(g) a pair of ground engaging wheels supporting said rear support columns and undercarriage; and
(h) a pair of upwardly rising forward support columns supporting said elevated frame that are each disposed outward to the side of one of said side beams at a position rearward of the front of said side beams to have the side beams cantilever forward of the forward support columns, said rear support columns rise obliquely to the vertical to downwardly converge toward one another with a distance therebetween at the lower ground engaging ends less than one-third the distance between the lower ground engaging ends of said forward support columns.

2. A straddle carrier as in claim 1 including: steerable ground engaging wheel means located at the bottom of said forward support columns.

3. In a straddle carrier the combination comprising:
(a) an elevated rectangular frame having a pair of horizontally disposed elongate said beams paralleling and spaced from one another;
(b) a pair of upwardly, rising rear columns supporting said elevated frame at the after end thereof that are in a plane normal to said side beams and which downwardly converge toward one another to provide a wider support at their top ends than at their bottom ends;
(c) an undercarriage in the plane of and extending between said rear support columns at their lower ends;
(d) operating machinery carried by said undercarriage;
(e) a pair of rear ground engaging wheels beneath said undercarriage and rear support columns that are each steerable, said pair of ground engaging wheels being aligned with one another in the plane of said rear support columns;
(f) a pair of upwardly, rising front columns supporting said elevated frame that are each disposed outwardly to the side of one of said side beams;
(g) supplementary framework extending sidewardly from each side beam that connects with a front column, to have said front columns each at a position rearwardly of the forward ends of said side beams whereby the side beams cantilever forward from such columns, and to have the side beams at a distance from one another approximately two-thirds the distance between said front columns;
(h) a steerable ground engaging wheel at the bottom of each of said front columns, with the distance between centers of such wheels being at least three times the distance between centers of said rear ground engaging wheels;
(i) a trolley running along and bridging between said side beams that travels between a position forward of and cantilevering outward from said front columns to a rearward position at the rear of said frame; and
(j) load hoisting means carried by said trolley.

4. In a straddle carrier the combination comprising:
(a) an elevated frame having:
(i) right and left horizontally disposed side beams paralleling and spaced from one another;
(ii) a rear crosswise beam spanning between and connecting said side beams at their after ends;
(iii) a front crosswise beam spanning between and connecting said side beams at their forward ends;
(b) a pair of rear support columns depending from the rear of said elevated frame in positions that underlie said rear crosswise beam;
(c) an undercarriage extending between and connecting the lower ends of said rear support columns which is in a common plane with the columns;
(d) power means for the carrier supported by said undercarriage;
(e) a pair of ground engaging wheels supporting said rear support columns and undercarriage that are each steerable and aligned with one another in said common plane, and at least one wheel being a driven wheel;
(f) supplementary framework extending sidewardly from each side beam of said elevated frame that comprises a pair of outwardly convergent box members that meet at an apex to be in a position rearward of the forward ends of said side beams whereby the side beams cantilever forward from the columns;
(g) a pair of front support columns, each disposed sidewardly from said elevated frame and depending from an apex of a supplementary framework;
(h) a pivoted, steerable ground engaging wheel at the bottom of each of said depending forward support columns, with at least one of said wheels being a driven wheel;
(i) a rail running along the top of each side beam;
(j) an elongate trolley running on and bridging between said rails, said trolley traveling between a position forward of and cantilevering outward from said forward support columns and rearward position over the area bounded by said ground engaging wheels; and
(k) load hoisting means carried by said trolley.

5. In a straddle carrier for handling elongated loads such as shipping containers and vans, the combination comprising:
a pair of elevated side beams horizontally spaced from one another;
elevated cross beams connecting said side beams at the rear thereof and at the front thereof to form an open centered rectangular, horizontally disposed frame;
a trolley that bridges between and runs along said side beams to traverse the open centered area of said rectangular frame;
load lifting means carried by said trolley adapted to support elongated loads with their long dimension transversely of said side beams;
a trusswork extending sidewardly from each side beam;

an upright, self-supporting front column depending from each truss at a position sidewardly of said frame and to the rear of the front of said frame, to provide a space beneath said frame larger than the distance between said side beams to move elongate loads from the front of the frame between said front columns to a rearward position beneath the frame and behind said front column; and rear support structure for said frame comprising depending rear columns to the rear of the open center of said frame that are spaced rearwardly of said front columns to permit straddling of a load disposed between the front columns and the rear support structure, said rear columns rising obliquely to the vertical to downwardly converge toward one another with a distance therebetween at the lower ground engaging ends less than one-third the distance between the lower ground engaging ends of said front columns.

* * * * *

UNITED STATES PATENT AND TRADEMARK OFFICE

CERTIFICATE OF CORRECTION

PATENT NO. : 4,256,230

DATED : March 17, 1981

INVENTOR(S) : Clinton B. Clark, Jr. et al

It is certified that error appears in the above-identified patent and that said Letters Patent are hereby corrected as shown below:

Column 2, line 17, "near" should be --rear--.

Column 3, bridging lines 54 and 55, "walkway" should be --walkways--.

Column 4, line 29, after "oblique", --matching-- is omitted.

Column 5, line 55, "the" should be --and--.

Column 5, line 66, "sise" should be --side--.

Signed and Sealed this

Thirtieth Day of June 1981

[SEAL]

Attest:

RENE D. TEGTMEYER

Attesting Officer

Acting Commissioner of Patents and Trademarks